US009169838B2

(12) United States Patent
Kösters et al.

(10) Patent No.: US 9,169,838 B2
(45) Date of Patent: Oct. 27, 2015

(54) LIQUID RING VACUUM PUMP WITH CAVITATION REGULATION

(71) Applicants: Heiner Kösters, Itzehoe (DE); Matthias Tamm, Itzehoe (DE); Daniel Schütze, Itzehoe (DE)

(72) Inventors: Heiner Kösters, Itzehoe (DE); Matthias Tamm, Itzehoe (DE); Daniel Schütze, Itzehoe (DE)

(73) Assignee: Sterling Industry Consult GmbH, Itzehoe (DE)

( * ) Notice: Subject to any disclaimer, the term of this patent is extended or adjusted under 35 U.S.C. 154(b) by 0 days.

(21) Appl. No.: 14/364,083

(22) PCT Filed: Dec. 12, 2012

(86) PCT No.: PCT/EP2012/075254

§ 371 (c)(1),
(2) Date: Jun. 10, 2014

(87) PCT Pub. No.: WO2013/087708

PCT Pub. Date: Jun. 20, 2013

(65) Prior Publication Data

US 2014/0377084 A1 Dec. 25, 2014

(30) Foreign Application Priority Data

Dec. 12, 2011 (EP) ..... 11193012

(51) Int. Cl.
*F04C 19/00* (2006.01)
*F04C 28/28* (2006.01)
(Continued)

(52) U.S. Cl.
CPC ..... *F04C 19/004* (2013.01); *F04C 19/00* (2013.01); *F04C 25/02* (2013.01); *F04C 28/08* (2013.01);
(Continued)

(58) Field of Classification Search
CPC ..... F04C 19/00; F04C 19/004; F04C 28/06; F04C 28/08; F04C 28/24; F04C 28/26; F04C 2220/10; F04C 2240/81; F04C 2270/05; F04C 2270/12; F04C 2270/86; F04C 25/02; F04C 5/00; F04C 2/44; F04C 2/40; F04C 2270/125
USPC ..... 417/68
See application file for complete search history.

(56) References Cited

U.S. PATENT DOCUMENTS 4,257,747 A * 3/1981 Goldman ..... 417/63
4,655,688 A * 4/1987 Bohn et al. ..... 417/18
(Continued)

FOREIGN PATENT DOCUMENTS

| | | |
|---|---|---|
| DE | 3520538 | 12/1986 |
| DE | 4036516 | 5/1991 |
| DE | 09306559 | 7/1993 |
| EP | 00943805 | 9/1999 |

OTHER PUBLICATIONS

Search Report, PCT/EP2012/075254 Jan. 8, 2014.

*Primary Examiner* — Bryan Lettman
*Assistant Examiner* — Timothy P Solak
(74) *Attorney, Agent, or Firm* — Alix, Yale & Ristas, LLP

(57) ABSTRACT

A method for operating a liquid ring vacuum pump employs taking vibration measurements of the pump and comparing the measurements with a prescribed cavitation threshold. In addition, a measurement representing the liquid content in the gas to be conveyed is taken. This measurement is compared with a prescribed threshold. The rotational speed of the liquid ring vacuum pump is reduced if the prescribed cavitation threshold has been exceeded and the liquid content is less than the prescribed threshold. The rotational speed is increased if the prescribed cavitation threshold has been exceeded and the liquid content is greater than the prescribed threshold. A liquid ring vacuum pump is designed for implementing the method. Due to the regulation depending on the oscillations of the pump, the pump can be operated near the cavitation boundary without any risk of damage.

20 Claims, 5 Drawing Sheets

(51) Int. Cl.
*F04C 28/08* (2006.01)
*F04C 25/02* (2006.01)

(52) U.S. Cl.
CPC ..... *F04C 28/28* (2013.01); *F04C 2220/10* (2013.01); *F04C 2240/81* (2013.01); *F04C 2270/05* (2013.01); *F04C 2270/12* (2013.01); *F04C 2270/125* (2013.01); *F04C 2270/44* (2013.01); *F04C 2270/86* (2013.01)

(56) References Cited

U.S. PATENT DOCUMENTS

| | | | | | |
|---|---|---|---|---|---|
| 4,699,570 | A | * | 10/1987 | Bohn | 417/6 |
| 5,228,840 | A | * | 7/1993 | Swank | 417/211 |
| 5,736,054 | A | * | 4/1998 | Feller et al. | 210/739 |
| 2007/0059185 | A1 | * | 3/2007 | Olivares et al. | 417/68 |
| 2011/0200450 | A1 | * | 8/2011 | Shelley et al. | 417/1 |

* cited by examiner

LIQUID RING VACUUM PUMP WITH CAVITATION REGULATION

BACKGROUND

The invention relates to a method for operating a liquid ring vacuum pump. In the method, measured vibration values of the pump are recorded and are compared with a predefined cavitation threshold value. Moreover, the invention relates to a liquid ring vacuum pump which is suitable for carrying out the method.

In liquid ring vacuum pumps, there is the problem that cavitation can occur in different operating states. If the pump is operated over a relatively long time period under cavitation conditions, this represents a high mechanical load for the components of the pump, by way of which high mechanical loads the pump can quickly be destroyed. Previous liquid ring vacuum pumps are therefore designed in such a way that a sufficient distance is always maintained from the operating states, in which cavitation can occur. Although the pump is therefore protected against damage as a result of cavitation, part of the possible performance capability of the pump is not utilized as a result of the distance from the cavitation limit.

SUMMARY

A pump and a method for operating a pump is proposed wherein the efficiency is increased.

In the method, a measured value is recorded which represents the liquid content in the gas to be delivered, and the measured value is compared with a predefined limiting value. The rotational speed of the pump is reduced if the predefined cavitation threshold value is exceeded and the liquid content lies below the predefined limiting value. The rotational speed of the pump is increased if the predefined cavitation threshold value is exceeded and the liquid content lies above the predefined limiting value.

First of all, some terms will be explained. The liquid which forms the liquid ring of the pump is called operating liquid. A distinction is to be made between this and a liquid which is driven by the gas to be delivered and is called condensate in the following text. The term condensate is not restricted to liquids which have formed as a result of condensation, but rather also comprises other liquids which are driven by the gas. In particular, it is not necessary that the condensate is a different material to the operating liquid. If the condensate enters into the pump, it can mix with the operating liquid. The same liquid which has entered as condensate is therefore not necessarily delivered out of the pump. The term liquid content relates to liquid/condensate which is driven by the gas to be delivered.

The cavitation threshold value is selected in such a way that a conclusion can be made from measured vibration values above the cavitation threshold value that cavitation is occurring in the pump, whereas there is no cavitation in the pump in the case of measured vibration values below the cavitation threshold value. The specific value of the cavitation threshold value depends both on the design of the pump and on the type of sensor and the recording of the measured values. The cavitation threshold value can be determined readily for every individual pump by way of experiments.

The limiting value for the liquid content is likewise dependent on the specific design of the pump. In one pump, very small quantities of condensate already trigger the cavitation. In another pump, a certain quantity of condensate can be driven, without the operation of the pump being impaired. This can also be determined readily for every pump by way of experiments. It is also conceivable that the limiting value changes depending on the rotational speed of the pump, that is to say that the limiting value is a function which is dependent on the rotational speed. The specification that the measured value is compared with a limiting value is to be understood broadly. If, for example, a conclusion is made about the liquid content from indirect measurements, the comparison with the limiting value can be that features are identified in the indirect measurement which indicate a high or low liquid content.

It has been recognized that it is not possible in every case in liquid ring vacuum pumps, as opposed to other types of pumps (cf., for instance, DE 35 20 538 A1), to stop the cavitation in the pump again by lowering of the rotational speed. A reduction of the rotational speed actually helps only in certain operating states, for example, if the cavitation is produced by the fact that the pump is operated at a high rotational speed and with a low intake pressure. This cavitation is called classic cavitation.

If, in contrast, the cavitation is produced by the fact that condensate is fed to the pump together with the gas to be delivered, it would even be counter-productive to lower the rotational speed of the pump. At the reduced rotational speed, the pump would namely even more no longer be in the position to convey the excess liquid out of the pump. However, it is actually possible to convey the excess liquid out of the pump by way of an increase in the rotational speed. The increase in the rotational speed therefore brings it about in this case that the cavitation is eliminated.

This finding is utilized to propose a method, by way of which the operation of the pump can be adapted automatically in the case of different types of cavitation. In the method, in each case two criteria are combined, in order to decide whether the rotational speed is increased or decreased. If the cavitation threshold value has been exceeded and the liquid content is low, the rotational speed is reduced. If the cavitation threshold value has been exceeded and the liquid content is high, the rotational speed is increased. The method step of increasing the rotational speed of the pump after the occurrence of cavitation is precisely contrary to the established teaching, according to which it has been assumed that the rotational speed always has to be lowered in the case of cavitation.

Measured values from external sensors can be processed in the pump, in order to determine the liquid content of the gas to be delivered. To this end, a sensor which directly measures the liquid content can be provided in the space to be evacuated. A conclusion can also be made about the liquid content from other measured values which concern, for instance, the pressure or the temperature in the space to be evacuated.

In addition or as an alternative, measured values which are recorded at the pump can be used to determine the liquid content. It is possible, for example, to make a conclusion about the liquid content from measured values of a vibration sensor. Although the liquid content cannot be measured directly via a vibration sensor, it is shown that the cavitation which is caused by an excess of condensate causes characteristic vibrations which differ from the vibrations in the case of the classic cavitation. These characteristic properties can be determined by way of a suitable evaluation of the measured values of the vibration sensor. For example, a Fourier analysis can be performed and a conclusion can be made from the features of the frequency spectrum as to whether the cavitation is caused by increased liquid content or not. The specific appearance of the features depends on the design of the pump and the arrangement of the vibration sensor and possibly has to be determined in the individual case by way of experiments.

The measured values which are to be compared with the cavitation threshold value can be recorded by way of the same vibration sensor or another vibration sensor. The evaluation as to whether cavitation is present at all is simpler than the evaluation with regard to the different types of cavitation. For example, the cavitation threshold value can relate simply to the amplitude of the vibration. If the amplitude exceeds the cavitation threshold value, a conclusion can be made therefrom that there is cavitation.

Another possibility for making conclusions about the liquid content and therefore the type of cavitation from measured values which are recorded at the pump involves evaluating the internal motor data, such as the motor voltage and the motor current.

It occurs occasionally that the cavitation cannot be eliminated solely by way of an adaptation of the rotational speed. In this case, it can be provided to let additional air into the working space of the pump via a valve. Although the degree of efficiency of the pump drops as a result, the cavitation is eliminated reliably.

The operation of the pump can be based on a multiple-stage sequence. In a first method stage, the pump can be operated at a rotational speed which lies below the minimum rotational speed. Here, the minimum rotational speed denotes that rotational speed, at which the liquid ring in the pump is just stable. In this method stage, the pump is therefore operated without a stable liquid ring. In this operating state, the pump which is actually designed to deliver gas can be utilized to first of all convey a quantity of liquid out of the space to be evacuated. The vanes of the impeller then act like blades, by way of which the liquid is guided through the pump. A separate condensate pump becomes superfluous as a result.

If the liquid has been removed from the space to be evacuated in this way, a transition can be made to normal vacuum operation, in which the pump is operated at a rotational speed which lies above the minimum rotational speed. The concept of first of all operating the pump at a rotational speed below the minimum rotational speed, in order to transport away liquid, and then of continuing the vacuum operation at a rotational speed above the minimum rotational speed has independent inventive content, even without measured vibration values being recorded, the liquid content being determined and the rotational speed being adapted. The following description of further method stages substantiates the independent inventive content.

After the transition to vacuum operation, the liquid ring vacuum pump can first of all be operated at a maximum rotational speed in a second method stage, in order to convey as large a quantity of gas as possible out of the space to be evacuated in as short a time as possible. In this operating state, there is the risk of classic cavitation occurring in the liquid ring with decreasing pressure. The classic cavitation can be counteracted by way of a reduction in the rotational speed. The pump can be operated close to the cavitation limit in this way, the rotational speed being reduced further and further as the pressure becomes lower. Here, the term cavitation limit denotes an operating state of the pump, in which first signs of cavitation are exhibited.

If the pressure in the space to be evacuated has dropped to the desired value, the rotational speed of the pump can be reduced to a value close to the minimum rotational speed in a third method stage. Energy is saved as a result of the operation at a low rotational speed. If cavitation occurs at a low rotational speed of this type, this is as a rule a result of an increased liquid content in the gas to be delivered. If cavitation therefore occurs, it can be counteracted by way of an increase in the rotational speed.

In this way, the pump can be used, for example, during disinfection in hospitals. The object to be disinfected is introduced into a chamber and is treated with hot steam. Subsequently, a chamber can be evacuated by way of the method according to the invention. The condensate can first of all be transported away at a low rotational speed. By the pump subsequently being operated at a maximum rotational speed and the rotational speed then being lowered along the cavitation limit, time is saved during the actual evacuation. Energy is saved by the low pressure finally being maintained by way of operation at a low rotational speed.

Moreover, the invention relates to a liquid ring vacuum pump which can be operated in accordance with the method. The pump comprises a pump housing, an impeller which is mounted eccentrically in the pump housing, and a vibration sensor for recording vibrations of the pump. A logic module is provided which compares a measured value of the vibration sensor with a predefined cavitation threshold value and which compares a measured value which represents the liquid content of the gas to be delivered with a first limiting value. A control unit of the pump is designed to adapt the rotational speed of the pump. Here, the control unit is designed to reduce the rotational speed if the predefined cavitation threshold value has been exceeded and the liquid content lies below a predefined limiting value. Here, the control unit is designed to increase the rotational speed if the predefined cavitation threshold value has been exceeded and the liquid content lies above a predefined limiting value.

If cavitation occurs in the liquid ring of the pump, characteristic vibrations occur which differ from the vibrations during normal operation. First signs of cavitation can be determined by way of the vibration sensor, before the cavitation is pronounced to such an extent that damage to the pump can occur. The predefined cavitation threshold value is selected in such a way that it is not exceeded during normal operation of the pump, but rather only when the pump approaches the cavitation limit.

The predefined cavitation threshold value is selected in a suitable manner for the respective pump. The cavitation threshold value can relate, for example, to the amplitude of the vibrations. It is also possible that the threshold value relates to defined characteristic properties of the vibrations which are triggered by cavitation. It can be the case, for example, that vibrations in defined frequencies occur with particular intensity during cavitation.

In addition or as an alternative to the adaptation of the rotational speed, the distance from the cavitation limit can also be increased by virtue of the fact that the pressure in the interior of the pump is increased. For this purpose, the pump can have a duct which extends from outside through the pump housing into the interior of the pump. The duct is provided with a valve which is closed in the normal state. The valve can be opened briefly after the threshold value is exceeded, in order to let gas from the surroundings into the interior of the pump. As a result, a distance from the cavitation limit is established again.

The vibration sensor is preferably connected to the pump housing, with the result that it determines vibrations which occur in the pump housing. The vibration sensor can be arranged where the vibrations which are caused by cavitation are produced, that is to say in the vicinity of the impeller. The vibration sensor can be arranged, for example, on the circumference or on the end side of this region of the housing.

However, no electronic components are normally otherwise arranged in the region of the impeller. If the vibration sensor is arranged there, this has the disadvantage as a result that cables have to be laid additionally. It can therefore be advantageous if the vibration sensor is arranged in a region of the pump housing, in which there are electronic components in any case. This can be, for example, the region, in which the control unit for the drive is also arranged. This may be suitable, in particular, if the pump is of monobloc configuration. Monobloc configuration means that the pump and the drive are surrounded by a common pump housing. The vibrations which are produced in the region of the impeller propagate through the pump housing and can also be measured satisfactorily at another location. If the control unit for the drive of the pump is connected to the pump housing, the vibration sensor can be integrated into the control unit.

The pump can be developed by way of further features which are described above with reference to the method.

BRIEF DESCRIPTION OF THE DRAWINGS

In the following text, the invention will be described by way of example using advantageous embodiments with reference to the appended drawings, in which.

DETAILED DESCRIPTION

Figure 1:
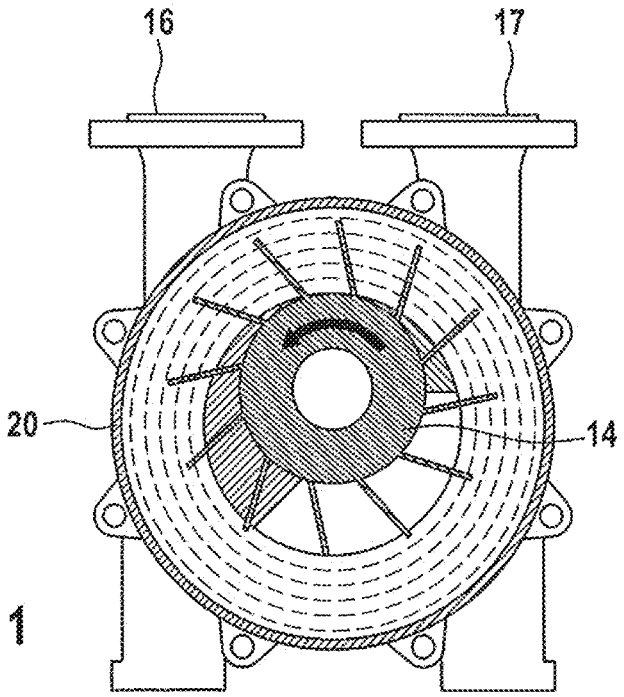
FIG. 1 shows a diagrammatic sectional illustration of a liquid ring vacuum pump.

In a liquid ring vacuum pump which is shown in FIG. 1, an impeller 14 is mounted eccentrically in a pump housing 20. Liquid in the interior of the pump is driven by the impeller 14 which is in rotation, and forms a liquid ring which extends radially to the inside from the outer wall of the pump housing 20. On account of the eccentric mounting, the vanes of the impeller 14 protrude to different depths into the liquid ring depending on the angular position. The volume of a chamber which is enclosed between two vanes changes as a result. The liquid ring therefore acts like a piston which moves up and down in the chamber during a revolution of the impeller 14.

A duct leads from an inlet opening 16 into the interior of the pump, in which the impeller 14 rotates. The duct 16 opens in the region, in which the vanes of the impeller 14 emerge from the liquid ring, that is to say in which the chamber which is enclosed between two vanes is enlarged. As a result of the enlarging chamber, gas is sucked through the inlet opening 16 into the chamber. After the chamber has reached its maximum volume, the liquid ring penetrates into the chamber again during the further rotation of the impeller 14. When the gas is compressed sufficiently by way of the liquid ring which penetrates further, it is output again at atmospheric pressure through an outlet opening 17. A liquid ring vacuum pump of this type serves to evacuate a space which is connected to the inlet opening 16 to a pressure of, for example, 50 millibar.

Moreover, the pump is equipped with a duct which is called a cavitation bore and extends from the outside into the interior of the pump. A solenoid valve is arranged in the duct, by way of which solenoid valve the duct can optionally be opened or closed.

Figure 2:
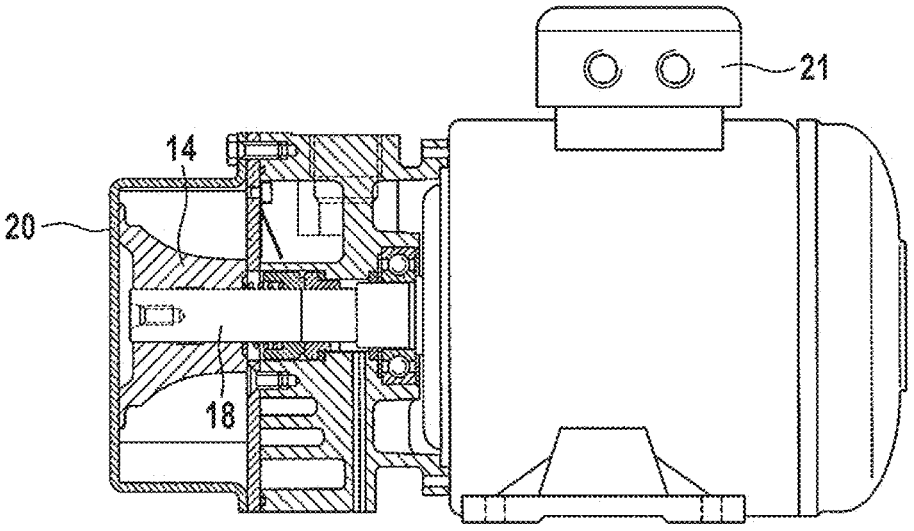
FIG. 2 shows the pump from FIG. 1 in a side view.

According to FIG. 2, the impeller 14 is connected via a shaft 18 to a drive motor. The pump is of monobloc configuration, that is to say the drive and the impeller 14 are accommodated jointly in the pump housing 20. Moreover, a control unit 21 is arranged on the pump housing 20, via which control unit 21 electrical energy is fed to the drive and the rotational speed of the pump is set.

Figure 3:
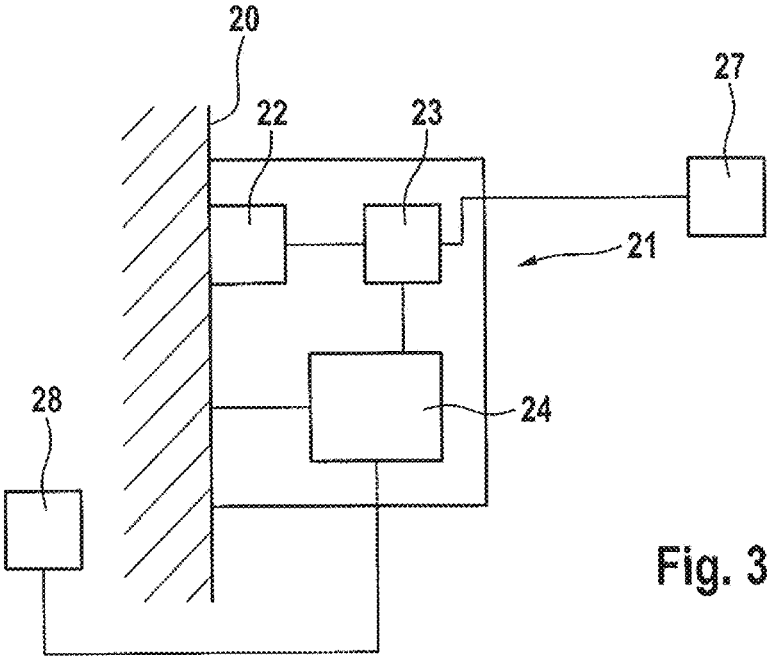
FIG. 3 shows a control unit of a liquid ring vacuum pump.

As the diagrammatic illustration of FIG. 3 shows, the control unit 21 comprises a vibration sensor 22, a logic module 23 and an actuating module 24. Moreover, measured values from an external sensor 27 are fed to the control unit 21.

The vibration sensor 22 is connected to the pump housing 20, in order to determine vibrations of the pump housing 20. The measured values of the vibration sensor 22 are transmitted continuously to the logic module 23. The logic module 23 compares the measured values with a predefined cavitation threshold value 26 (see FIG. 5). If the cavitation threshold value 26 is exceeded, this is evaluated as an indication that cavitation has occurred in the pump. It still cannot be derived, however, solely from the exceeding of the cavitation threshold value whether it is classic cavitation or cavitation on account of an increased liquid content. Measured values from the external sensor 27 are therefore additionally fed to the logic module, from which measured values the magnitude of the liquid content of the gas to be delivered is derived. The external sensor 27 can be, for example, a sensor which directly measures the liquid content in the feed line to the pump. It is also possible that the external sensor 27 measures values, from which a conclusion can be made indirectly about the liquid content. These values can concern, for example, the temperature, the pressure or the quantity of supplied steam in the space to be evacuated.

In this way, the information is combined in the logic module 23, using which information a decision can be made as to whether the rotational speed has to be increased or decreased, in order to eliminate the cavitation. If cavitation occurs and the gas to be delivered contains no condensate or only a very small quantity of condensate, the rotational speed is decreased. If cavitation occurs and the gas to be delivered contains a relatively large quantity of condensate, the rotational speed is increased. A corresponding signal is given to the actuating module 24 by the logic module 23, with the result that the drive of the pump is set correspondingly. In both cases, the adaptation of the rotational speed leads to the cavitation being stopped again in the pump.

In addition or as an alternative to the rotational speed adaptation, the solenoid valve 28 can be opened briefly via the actuating module 24, with the result that air from the surroundings can penetrate into the interior of the pump. The distance from the cavitation limit is also increased by way of the associated pressure increase in the interior of the pump.

Figure 4:
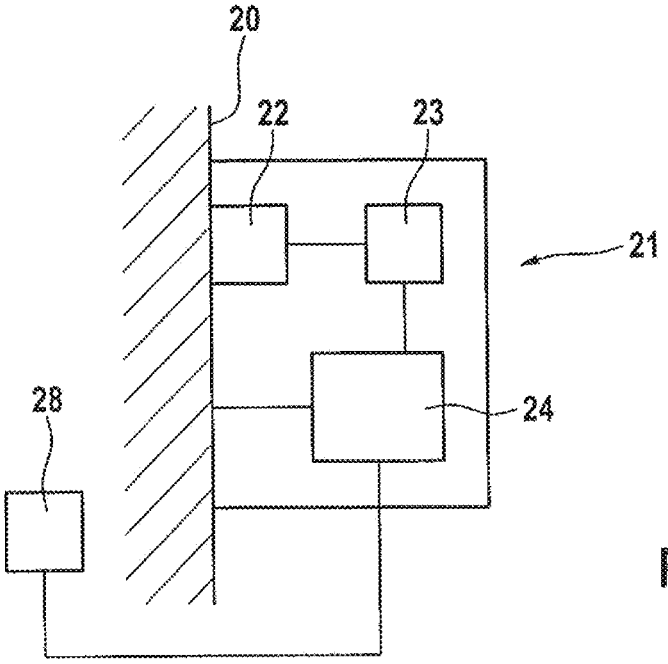
FIG. 4 shows the view from FIG. 3 in another embodiment.

In the embodiment according to FIG. 4, the logic module 23 does not receive any information from an external sensor. Instead, the measured values from the vibration sensor 22 are evaluated in two ways. Firstly, the amplitude of the vibration is compared with the predefined cavitation threshold value. If the amplitude exceeds the threshold value, this indicates cavitation. Secondly, a Fourier transformation of the measured values is performed and the frequency distribution of the vibrations is taken into consideration. To this end, for example, the third-octave band at 5 kHz and the third-octave band at 10 kHz can be singled out. The classic cavitation is manifested by way of a characteristic distribution in the 5 kHz third-octave band, whereas the cavitation which is caused by way of increased liquid content brings about a characteristic frequency distribution in the 10 kHz third-octave band. By way of the evaluation of the two third-octave bands in the logic module 23, it can therefore be determined which type of cavitation it is. In the context of the invention, this evaluation of the frequency bands represents a comparison between a limiting value and measured values which represent the liquid content.

The pump can be used, for example, in such a way that it is operated in a first stage of the method at a rotational speed of, for example, 1000 rpm. The minimum rotational speed, above which the liquid ring is stable, lies at approximately 2000 rpm. At 1000 rpm, the pump is therefore operated considerably below the minimum rotational speed. In this operating state, the pump can be used to transport a quantity of liquid out of the space to be evacuated.

Figure 5:
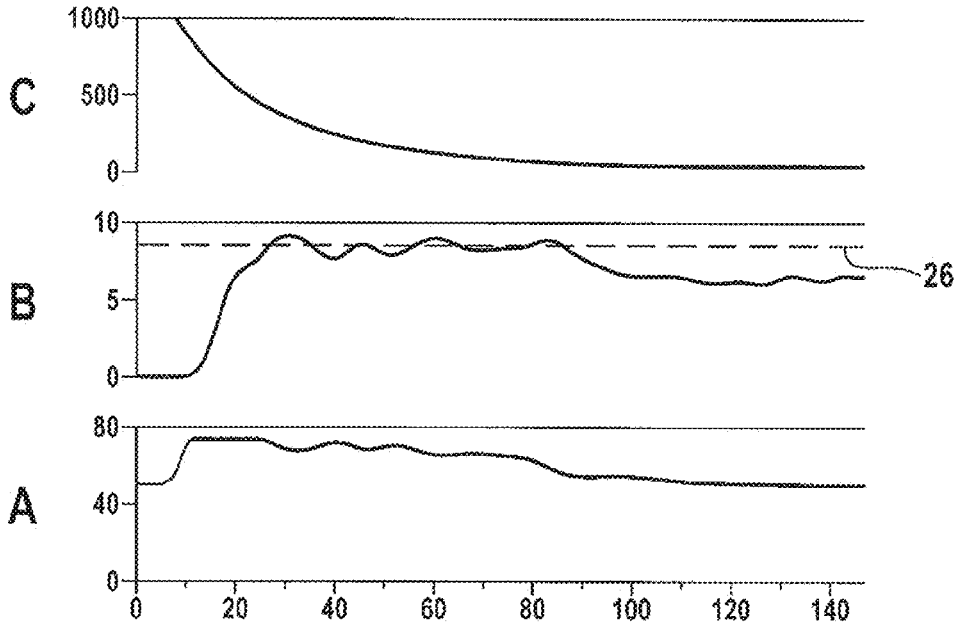
FIG. 5 shows a diagrammatic illustration of an operating sequence of the pump.

If no more liquid is contained in the space, the pump can change over into vacuum operation in a second stage of the method. FIG. 5 diagrammatically shows the second stage of the method, A representing the rotational speed of the pump in Hz, B showing the measured values which are recorded by way of the vibration sensor 22 on a relative scale between 0 and 10, and C specifying the pressure in the space to be evacuated in millibar. The space to be evacuated has a volume of 400 I. The time in seconds is plotted on the horizontal axis. At the time t =0, atmospheric pressure of a little over 1000 mbar prevails in the space to be evacuated and the vibration sensor does not measure any vibrations of the pump. After the transition into vacuum operation, the pump is accelerated within a short time to the maximum rotational speed of approximately 5400 rpm. The pressure in the space drops rapidly to values of approximately 500 mbar. At the time t =20 s, the vibrations which are measured by way of the vibration sensor 22 for the first time exceed the predefined cavitation threshold value 26 which is shown using a dashed line in division B of FIG. 5. The rotational speed of the pump is thereupon reduced somewhat, which leads to the vibrations dropping below the predefined cavitation threshold value 26 again within a short time. The rotational speed is subsequently increased again somewhat, until the cavitation limit is reached again. By way of the method, the container which has a volume of 400 I is evacuated within 80 seconds to a pressure of 60 mbar. If the same pump is operated at a constant rotational speed, the same operation takes 113 seconds.

When the final pressure is reached, a lower rotational speed is sufficient, in order to maintain the pressure. In the third stage of the method, the rotational speed is therefore reduced to such an extent that it lies just above the minimum rotational speed. If cavitation occurs in this state, this is due as a rule to an increased liquid content in the gas to be delivered. Exceeding of the cavitation threshold value firstly and a high liquid content secondly are therefore determined in the logic module 23. As a result, the logic module 23 will transmit the command to the control unit 24 to increase the rotational speed.

Figure 6:
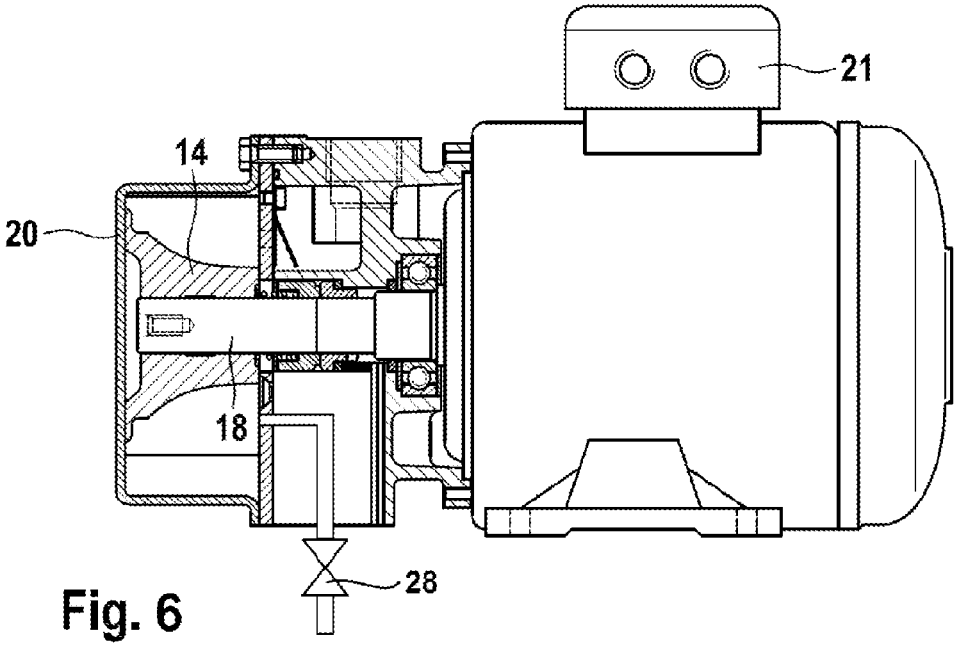
FIG. 6 shows the view from FIG. 2 in another embodiment.
Figure 7:
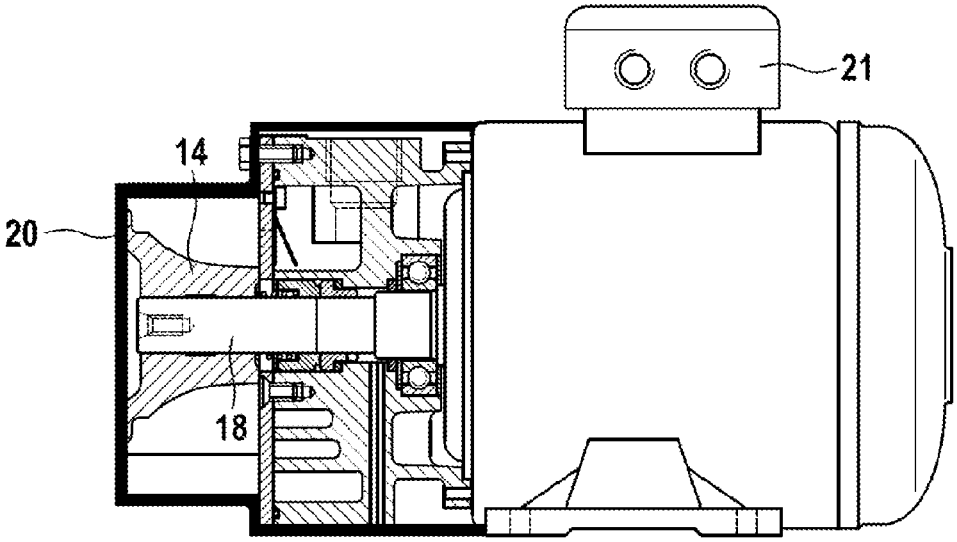
FIG. 7 shows the view from FIG. 2 in another embodiment.
Figure 8:
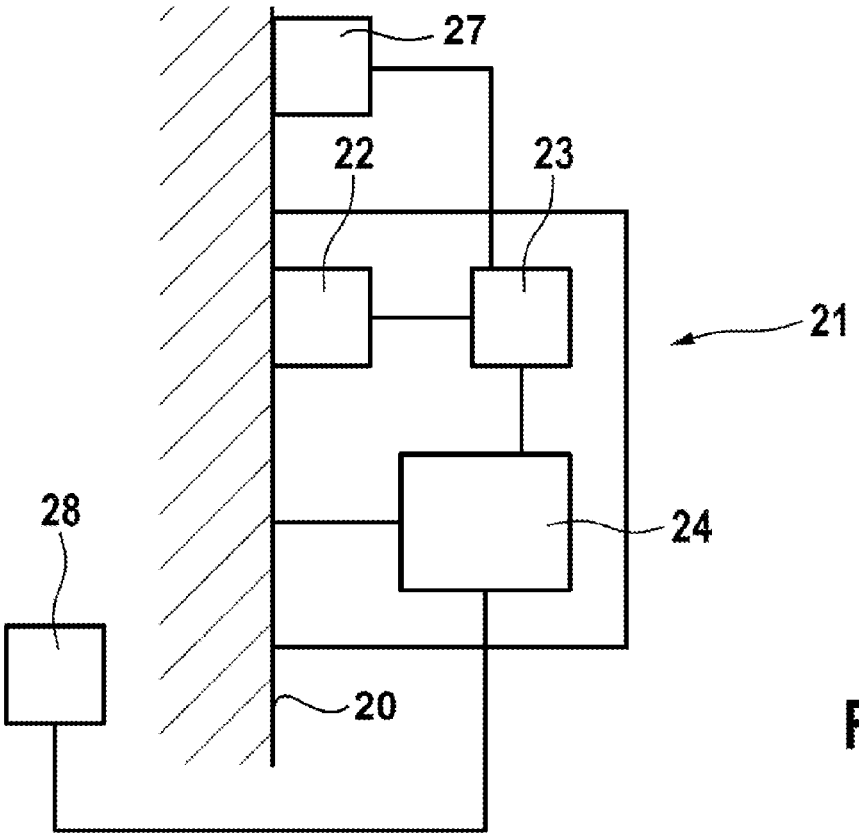
FIG. 8 shows the view from FIG. 3 in another embodiment.

In the embodiment according to FIG. 6, the pump is of monobloc configuration. FIG. 7 depicts one embodiment in which the duct extends from outside into the interior of the pump as well as the valve. FIG. 8 depicts the sensor (27) for measuring values at the pump.

The invention claimed is:

1. A liquid ring vacuum pump having a gas with a liquid content, said liquid ring pump having a pump housing, and an impeller which is mounted eccentrically in the pump housing and operates at a rotational speed, and a vibration sensor for recording vibrations of the pump, characterized in that the pump comprises a logic module which compares a measured value of the vibration sensor with a predefined cavitation limiting value and which compares a measured value which represents the liquid content of the gas to be delivered with a first limiting value, a control unit being provided to adapt the rotational speed of the pump:

i. the control unit reduces the rotational speed if the predefined cavitation threshold value has been exceeded and the liquid content lies below a predefined limiting value;

ii. the control unit increases the rotational speed if the predefined cavitation threshold value has been exceeded and the liquid content lies above the predefined limiting value.

2. The liquid ring vacuum pump as claimed in claim 1, wherein the pump has an interior characterized in that the pump housing has a duct which extends from outside into the interior of the pump, and in that the duct is provided with a valve.

3. The liquid ring vacuum pump as claimed in claim 2, characterized in that the valve is opened after the predefined cavitation threshold value is exceeded.

4. The liquid ring vacuum pump as claimed in claim 2, characterized in that the pump is of monobloc configuration.

5. The liquid ring vacuum pump as claimed in claim 2, characterized in that the vibration sensor is integrated into the control unit.

6. The liquid ring vacuum pump as claimed in claim 1, characterized in that the valve is opened after the predefined cavitation threshold value is exceeded.

7. The liquid ring vacuum pump as claimed in claim 6, characterized in that the pump is of monobloc configuration.

8. The liquid ring vacuum pump as claimed in claim 6, characterized in that the vibration sensor is integrated into the control unit.

9. The liquid ring vacuum pump as claimed in claim 1, characterized in that the pump is of monobloc configuration.

10. The liquid ring vacuum pump as claimed in claim 1, characterized in that the vibration sensor is integrated into the control unit.

11. A method for operating a liquid ring vacuum pump having a rotational speed for delivering a gas with a liquid content having the following steps:

a. recording measured vibration values of the pump and comparing the measured vibration values with a predefined cavitation threshold value;

b. recording a measured value which represents the liquid content in the gas to be delivered, and comparing the measured value with a predefined limiting value;

c. adapting the rotational speed of the liquid ring vacuum pump, i. the rotational speed being reduced if the predefined cavitation threshold value has been exceeded and the liquid content lies below the predefined limiting value;

ii. the rotational speed being increased if the predefined cavitation threshold value has been exceeded and the liquid content lies above the predefined limiting value.

12. The method as claimed in claim 11, characterized in that, in step b., measured values from an external sensor are processed.

13. The method as claimed in claim 11, characterized in that, in step b., measured values which are recorded at the pump are processed.

14. The method as claimed in claim 13, characterized in that, the measured values are limited as a result of processing the measured vibration values.

15. The method as claimed in claim 14, characterized in that the measured vibration values have a frequency spectrum and the frequency spectrum of the measured vibration values is taken into consideration.

16. The method as claimed in claim 11, characterized in that the vibration values comprise an amplitude and the cavitation threshold value relates to the amplitude.

17. The method as claimed in claim 11, wherein the pump has a working space and produces cavitation characterized in that air is let into the working space of the pump if the cavitation cannot be eliminated by adaptation of the rotational speed.

18. The method as claimed in claim 11, wherein the pump has a minimum rotational speed characterized in that the pump is operated in a first method stage at a rotational speed which lies below the minimum rotational speed.

19. The method as claimed in claim 18, characterized in that the pump is operated in a second method stage first of all at a maximum rotational speed, and in that the rotational speed is lowered after cavitation.

20. The method as claimed in claim 18, characterized in that the pump is operated in a third method stage at a rotational speed just above the minimum rotational speed.

* * * * *